US005719328A

United States Patent [19]

Gombash, Jr.

[11] Patent Number: 5,719,328

[45] Date of Patent: Feb. 17, 1998

[54] PRESSURE DROP TESTER FOR FILTER RODS

[75] Inventor: Joseph D. Gombash, Jr., Matthews, N.C.

[73] Assignee: Hoechst Celanese Corporation, Warren, N.J.

[21] Appl. No.: 672,354

[22] Filed: Jun. 25, 1996

[51] Int. Cl.[6] ..... G01N 15/08

[52] U.S. Cl. ..... 73/38

[58] Field of Search ..... 73/38

[56] References Cited

U.S. PATENT DOCUMENTS 4,069,704 1/1978 Grant et al. ..... 73/38
4,223,551 9/1980 Greve et al. ..... 73/38

OTHER PUBLICATIONS

Celanese Digital Pressure–Drop Tester Instruction Manual issued Sep. 1978 by Celanese Fibers Marketing Company.

*Primary Examiner*—Michael Brock
*Assistant Examiner*—Jay L. Politzer
*Attorney, Agent, or Firm*—Gregory N. Clements

[57] ABSTRACT

A device is provided for testing a pressure drop across a cigarette filter rod. The device includes an expansible sleeve for encapsulating a filter rod and a two stage vacuum pump connected thereto. A first controllable valve connects the outer surface of the sleeve to the vacuum pump to expand the sleeve so that a filter rod can be inserted. The first controllable valve also connects the end of the sleeve to the vacuum pump so that a measurable pressure drop is created across the filter rod. A second controllable valve is connected between an exhaust port of the vacuum pump and the end of the sleeve so that, after the testing has been completed, the filter rod will be ejected from the sleeve. The pressure testing device is thus self contained and does not require an external source of vacuum or compressed air.

10 Claims, 2 Drawing Sheets

PRESSURE DROP TESTER FOR FILTER RODS

FIELD OF THE INVENTION

The present invention relates to pressure drop testers for cigarette filter rods and more particularly relates to devices for testing the pressure drop across an encapsulated cigarette filter rod.

BACKGROUND OF THE INVENTION

An exemplary form of an apparatus for testing the pressure drop across cigarette filter rods is disclosed in U.S. Pat. No. 4,069,704 to Grant, et al., which is expressly incorporated herein by reference. This apparatus is not portable. The apparatus includes a tube shaped rod receptacle having an expansible air impervious sleeve mounted within the rod receptacle for encapsulating the cigarette filter rod. An external vacuum is applied to the rod receptacle which expands the encapsulating sleeve extending therethrough so that a filter rod may be inserted into the encapsulating sleeve. The vacuum is then released so that the encapsulating sleeve contracts and forms an airtight seal along the length of the rod. Accordingly, when an external vacuum is applied to one axial end of the cigarette filter rod, air will enter the rod only from the opposite axial end and not from the porous sides of the rod, which provides a more accurate pressure drop measurement. Once the cigarette filter rod has been tested, the vacuum is again applied to the outer surface of the sleeve so that the cigarette filter rod can be removed from the sleeve. The vacuum source used for creating the pressure drop through the cigarette filter rod may be the same as or separate from the vacuum source used to expand the encapsulating sleeve.

Subsequent improvements to the Grant, et al. apparatus include an ejector system for ejecting the filter rod from the encapsulating sleeve after the filter rod has been tested, but the apparatus is not portable. For example, as disclosed in the document entitled "Celanese Digital Pressure-Drop Tester Instruction Manual" issued September 1978 by Celanese Fibers Marketing Company, which is also herein incorporated by reference, a conduit is provided for connecting the encapsulator sleeve with an external regulated air source. Once the filter rod has been tested, a vacuum is again applied to expand the sleeve and then compressed air is applied to the end of the sleeve to eject the filter rod from the encapsulating sleeve.

As discussed above, the pressure drop may be measured by passing air through the filter rod at a constant volumetric flow rate and then measuring the pressure downstream of the filter rod relative to the pressure upstream of the filter rod (which is assumed to be atmospheric pressure). One way of providing a relatively constant flow rate is to pass the air through a critical flow orifice which will allow no more than a predetermined maximum flow rate through the orifice. As shown in the above-referenced document, a vacuum source is applied downstream of the orifice which is capable of exceeding the maximum flow rate of the orifice. The vacuum source may comprise a vacuum pump which draws in air to create the vacuum and which then exhausts the air from the pump. Accordingly, a relatively constant flow rate upstream of the orifice is provided.

These improvements provide an apparatus which advantageously ejects a cigarette filter rod from an encapsulating sleeve after it has been tested at a constant flow rate. However, the apparatus requires one or two external vacuum sources and a separate external compressed air source.

While a source of vacuum and a separate source of compressed air are usually readily available in most manufacturing plants, such sources are considerably more difficult to obtain in remote parts of the country or in non-industrialized countries of the world. In addition, even in manufacturing plants which include vacuum and air lines, it may be desirable to test the cigarette filter rods at places within the plant which are removed from such supply lines. Also, the conventional apparatus is not readily portable.

To improve testing ease and frequency, it would be highly advantageous to provide a pressure drop testing device which is self contained. Thus, there is a great need for a cigarette pressure drop testing device which is fully portable. Specifically, such a cigarette pressure drop testing device should not require a separate source of vacuum and a separate source of compressed air and could advantageously utilize the air exhausted from the vacuum pump. In addition, however, it is also desirable that such a device include an expansible encapsulating sleeve and an air ejection system of the type discussed above. However, there is currently no commercially available cigarette filter pressure drop testing device which is fully portable and which does not require connection to an external source of compressed air or an external source of vacuum.

SUMMARY OF THE INVENTION

The present invention provides an improved device for testing pressure drop across a filter rod which meets the needs discussed above. More specifically, the present invention provides a portable pressure drop testing device for cigarette filter rods which does not require an external source of vacuum or an external source of compressed air. In particular, the present invention includes a vacuum pump and at least one controllable valve for selectively applying vacuum to the end of an encapsulating sleeve to create a pressure drop through the filter rod or for creating a positive pressure at the end of the encapsulating sleeve to eject the cigarette filter rod therefrom.

The encapsulating sleeve is advantageously expansible and has opposed first and second open ends. The encapsulating sleeve is enclosed within a rigid vessel which is connected to the vacuum pump so that the encapsulating sleeve may be expanded and a cigarette filter rod inserted into the sleeve through the first end thereof. The vacuum pump includes at least one inlet port and at least one exhaust port, and in particular may be a two-stage pump wherein each stage includes a separate inlet port and exhaust port.

A first controllable valve is provided for fluidly connecting the inlet port of the first stage of the vacuum pump to the rigid vessel. Accordingly, operation of the first valve applies vacuum to the vessel, causing the encapsulating sleeve to be expanded so that a filter rod may be inserted into the sleeve or removed therefrom.

The first controllable valve can also provide a fluid connection between the inlet port of the first stage of the vacuum pump and the second end of the encapsulating sleeve. This causes vacuum to be drawn through the encapsulating sleeve and the cigarette filter rod to create the desired measurable pressure drop. A pressure sensor is connected between the inlet port of the first stage and the second end of the sleeve for measuring the pressure therein relative to atmospheric pressure so that the pressure drop across the filter rod can be ascertained.

A second controllable valve is also provided for connecting the exhaust port of the vacuum pump to the second end of the sleeve. When the exhaust port is so connected, pressurized air is supplied to the sleeve and the filter rod will be ejected from the first end of the sleeve.

A third controllable valve is connected to a manifold extending between the exhaust port of the first stage of the vacuum pump and the inlet port of the second stage of the vacuum pump. To increase the volumetric flow rate of air through the vacuum pump so as to eject the filter rod, the third controllable valve directs atmospheric air to the manifold thus bypassing the first stage of the vacuum pump. The third controllable valve may also connect the rigid vessel to the atmosphere so as to bleed the vacuum therefrom when the sleeve is in an expanded condition in order to allow the encapsulating sleeve to contract to its relaxed position.

The present invention thus provides a pressure drop tester for filter rods which includes an expansible encapsulating sleeve and which also provides for the ejection of the cigarette filter rod after the testing has been completed. The unique combination of the components of the present invention recited above and discussed in more detail below provide vacuum and compressed air for performing these functions and thus no external sources of vacuum or compressed air are necessary. Moreover, the pressure drop testing device according to the present invention can be self contained and fully portable, thereby solving a great need in the art.

BRIEF DESCRIPTION OF THE DRAWINGS

In the drawings which form a portion of the original disclosure of the invention and which are not necessarily drawn to scale.

DETAILED DESCRIPTION OF THE PREFERRED EMBODIMENT

Figure 1:
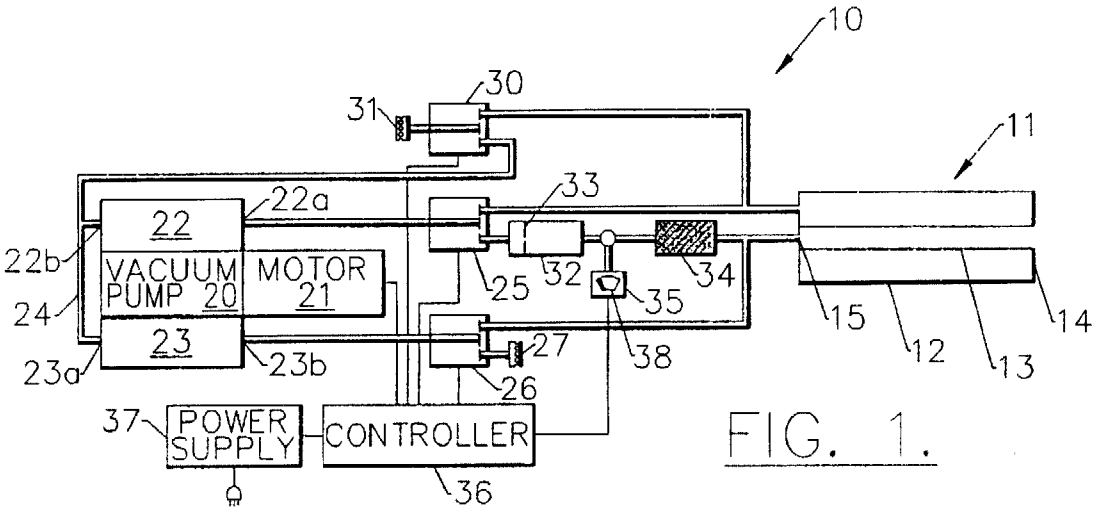
FIG. 1 is an overall schematic view of a pressure drop testing device according to the present invention.

Various apparatus embodiments and methods relating to the invention are set forth below. While the invention is described with reference to specific preferred apparatus including those illustrated in the drawings, it will be understood that the invention is not intended to be so limited. To the contrary, the invention includes numerous alternatives, modifications, and equivalents as will become apparent from consideration of the present specification including the drawings, the foregoing discussion, and the following detailed description.

The device 10 according to the present invention is illustrated in a non-operating condition in FIG. 1. The operation of the device will be discussed in detail below in connection with FIGS. 2, 3 and 4. The device 10 includes an encapsulator 11 which comprises a rigid outer vessel 12 and a fluid impervious encapsulating sleeve 13 extending therethrough. The rigid outer vessel 12 is tube shaped and defines an enclosed space around the encapsulating sleeve 13. In particular, the encapsulating sleeve 13 has first 14 and second 15 ends adjacent to the enclosed ends of the rigid vessel 12.

The encapsulating sleeve 13 is advantageously radially expansible and may be formed of any resilient but impervious material such as surgical tubing. The rigid vessel 12 is sealed to the outer surface of opposed end portions of the encapsulating sleeve 13 so as to define an enclosed hollow space within the vessel 12. The first end 14 of the encapsulating sleeve 13, however, remains open. Preferably, the encapsulator 11 is adjustable in length as disclosed in the above-incorporated Grant, et al. apparatus.

The device 10 also includes a vacuum pump 20 which may be powered by an attached motor 21. The vacuum pump 20 advantageously comprises a two-stage pump having a first stage 22 and a second stage 23 which are driven by a common motor 21.

The first stage 22 includes an inlet port **22*a* and an exhaust port 22*b*. Similarly, the second stage also includes an inlet port 23*a* and an exhaust port 23*b*. To obtain the desired sequential staging, a manifold 24 connects the exhaust port 22*b* of the first stage 22 with the inlet port 23*a* of the second stage 23**. One particularly suitable vacuum pump is Model N85.3 KTDC from KNF Neuberger, Inc. of Trenton, N.J. which has a flow rate in excess of 1.25 l/min.

Operatively connected to the inlet port **22*a* of the first stage 22 is a first controllable valve 25. The valve 25 is electronically activated and is switchable between at least two operative positions. The valve 25 is advantageously actuated by way of a solenoid and may be any type of pneumatic valve such as a rotary valve, gate valve or the like. As discussed in more detail below, in one of the positions, the first controllable valve 25 connects the vacuum pump 20 with the rigid vessel 12 so as to expand the encapsulating sleeve 13. In the second position, the first controllable valve 25 connects the vacuum pump 20 with the second end 15 of the encapsulating sleeve 13**.

A second controllable valve 26 is connected to the exhaust port **23*b* of the second stage 23 of the vacuum pump 20 and is preferably the same type of valve as the first valve 25. The second controllable valve 26 is moveable to an operative position where the exhaust port 23*b* is connected to the second end 15 of the encapsulating sleeve 13. Alternatively, the second controllable valve 26 can be moved to a position where the exhaust port 23*b* is vented to the atmosphere. A vent cap 27 may be provided for preventing foreign matter from entering the second controllable valve 26**.

A third controllable valve 30 is connected in a first operating position between the atmosphere and the rigid outer vessel 12 and is also preferably of the type discussed above. Accordingly, a vacuum drawn within the vessel 12 will bleed off as atmospheric air is drawn into the vessel. A vent cap 31 may be provided for the third controllable valve 30. The third controllable valve 30 is also connected in a second position to the manifold 24 between the exhaust port **22*b* of the first stage 22 and the inlet port 23*a* of the second stage 23**.

A flow limiter 32 is positioned in the line between the first controllable valve 25 and the second end 15 of the encapsulating sleeve 13. The flow limiter 32 includes a critical flow orifice 33 which limits the maximum volumetric flow rate of air through the limiter. Particularly, as the flow rate through the orifice 33 is increased, it approaches a maximum value at which point the air flow becomes "choked". A maximum volumetric flow rate of 17.5 $cm^3/s$ (1.05 l/min) is consistent with the standards of CORESTA, an international organization which establishes standards for the industry. A gas permeable particulate removal filter 34 may be connected in the line between the flow limiter 32 and the encapsulating sleeve 13 for preventing airborne particulate matter from entering the flow limiter 32.

A pressure sensor 35 is connected between the flow limiter 32 and the encapsulating sleeve 13. The pressure sensor 35 may comprise a conventional water column manometer or a pressure transducer for providing an electrical signal representative of a negative pressure applied thereto. The signal can be passed to an indicator 38 for providing a readout of the pressure drop. Preferred pressure transducers and indicators include Models DP-15-32-N-6-S-4-A and CD-379-1-7 respectively, which are both products of Validyne Engineering Corp. of Northridge, Calif.

The pressure sensor 35 is electrically connected to a controller 36. The controller 36 may also be connected to each of the selectively controllable valves 25,26 and 30, which are all preferably electronically activated, for controlling the sequence of their operation, which is discussed in more detail below. The motor 21 for the vacuum pump 20 may also be connected to and controlled by the controller 36. The controller 36 may include a timer for shutting down the vacuum pump motor 20 after a predetermined amount of time has elapsed.

In a preferred embodiment, the controller 36 comprises a plurality of electrical switches which, when moved to the appropriate positions, position the selectively controllable valves 25, 26 and 30 as discussed below and shown in the Figures. The term "controller" as used herein is intended to include all types of controllers and their equivalents including programmable logic controllers (PLC) and personal computers (PC) or the like. In addition, the controller 36 may comprise manually operated mechanical controls for the selectively operable valves 25, 26 and 30.

The controller 36 is preferably powered by a power supply 37 which can be connected to an external power source. The power supply 37 includes a transformer which converts the external power into a signal having the voltage and frequency characteristics necessary to operate the controller. In a preferred embodiment, the power supply 37 includes a conventional power conversion circuit which is capable of converting a wide variety of source voltages and frequencies, such as those which may be encountered in various foreign countries, into the desired input power signal. In the United States, it is preferred that the alternating source current be converted to a direct current. A particularly preferred power supply is model MAP55-1012 of Power-One™ power supplies and available from Newark Electronics of Newark, N.J.

The operation of the pressure drop tester 10 according to the invention will now be described with reference to FIGS. 2, 3 and 4. Initially, when it is desired to initiate a pressure drop test on a filter rod 40, the controller 36 moves the controllable valves 25,26,30 to the positions illustrated in FIG. 2. In addition, the motor 21 is started to drive both stages 22,23 of the vacuum pump 20.

Figure 2:
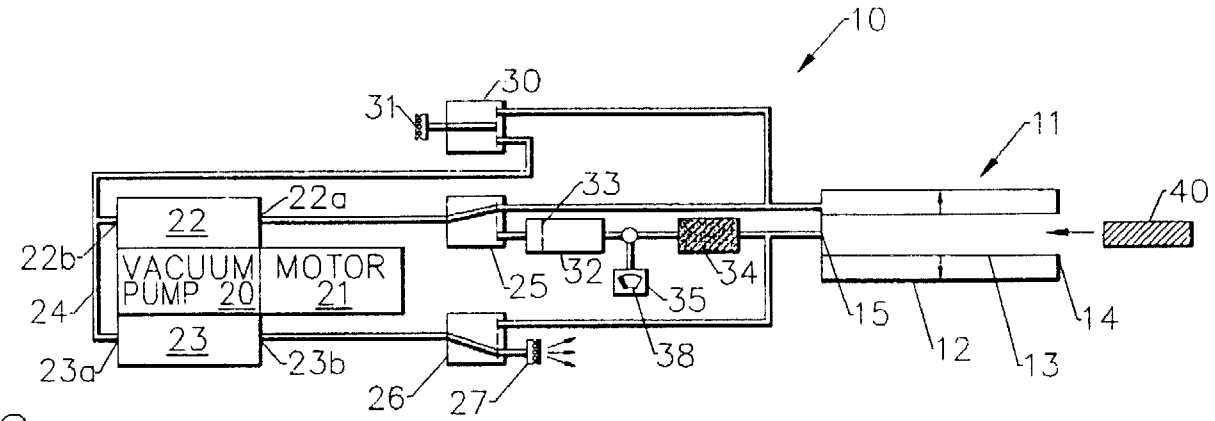
FIG. 2 is a schematic view of the pressure drop testing device showing an encapsulating sleeve being expanded to allow a filter rod to be placed in the sleeve.

In the arrangement shown in FIG. 2, the first controllable valve 25 is positioned such that the rigid vessel 12 is connected with the inlet port 22*a* of the vacuum pump 20. This provides vacuum to the interior of the rigid vessel 12 which causes the encapsulating sleeve 13 to expand in diameter. As also seen in FIG. 2, the second controllable valve 26 is positioned so as to connect the exhaust port 23*b* of the second stage 23 of the vacuum pump 20 with the vent cap 27 so that the air removed from the rigid vessel 12 will be drawn through the first stage 22 of the vacuum pump 20, through the manifold 24, through the second stage 23 and then exhausted from the device 10. Once the encapsulating sleeve 13 has been sufficiently expanded, the filter rod 40 may be inserted through the first end 14 thereof. It may be periodically desirable to calibrate the device according to the present invention and, in such situations, a conventional multicapillary glass pressure drop testing standard or the like may be inserted instead of the filter rod 40.

Figure 3:
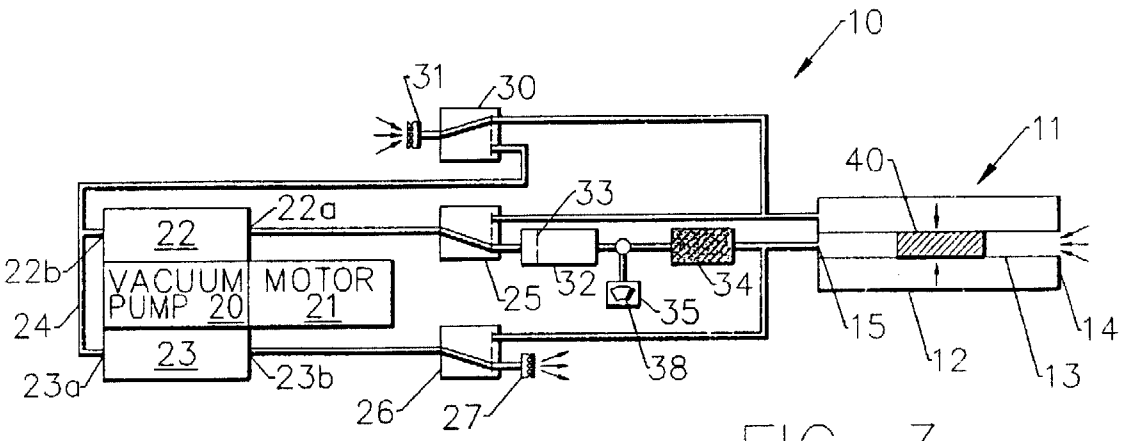
FIG. 3 is a schematic view of the pressure drop testing device showing the sleeve in a relaxed condition and a pressure drop being created across the cigarette filter rod.

After the filter rod 40 has been inserted in the sleeve 13, the valves 25,26,30 are moved to the positions illustrated in FIG. 3. Specifically, the third controllable valve 30 is moved so as to connect the interior of the vessel 12 with the atmosphere through the vent cap 31 allowing bleeding; i.e., releasing the vacuum within the vessel 12. The release of the vacuum allows the encapsulating sleeve 13 to relax and contract about the circumferential periphery of the filter rod 40. As a result, spurious air will not be drawn in through the circumferential periphery of the filter rod 40 and the filter rod will also be firmly gripped within the sleeve 13.

The first controllable valve 25 is also moved so as to connect the inlet port 22*a* of the first stage 22 of the vacuum pump 20 to the second end 15 of the encapsulating sleeve 13. Air is thus drawn in from the atmosphere through the first end 14 of the encapsulating sleeve 13, through the upstream and downstream axial ends only of the filter rod 40, and out the second end 15 of the sleeve 13. From there, the air is passed through the particulate removal filter 34 and the flow limiter 32.

The maximum flow rate capacity of the two-stage vacuum pump 20 exceeds the maximum flow rate of the flow limiter 32 such that a constant flow rate is drawn through the filter rod 40. The pressure sensor 35 measures the pressure in the line between the flow limiter 32 and the filter rod 40. This measurement is then compared to the pressure upstream of the filter rod 40 (atmospheric pressure) so that a pressure drop across the particular filter rod specimen being tested can be measured.

Figure 4:
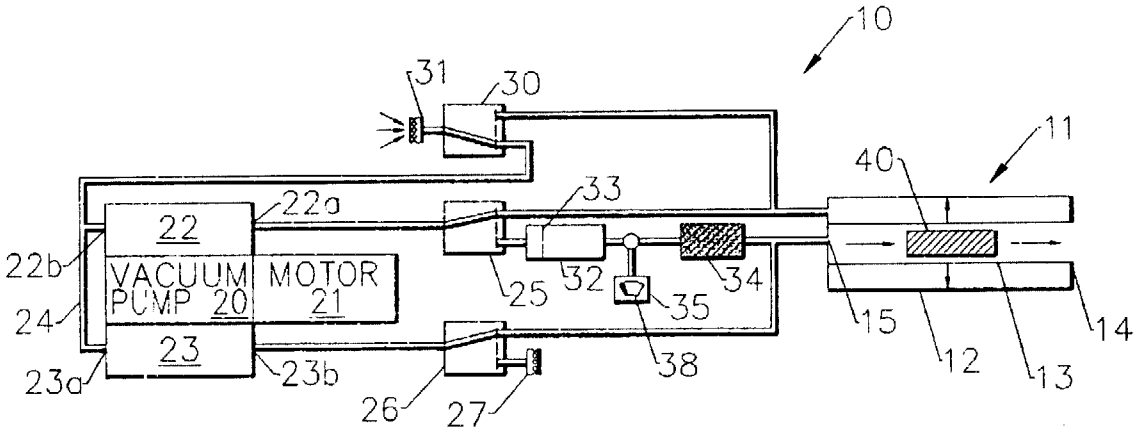
FIG. 4 is a schematic view of the pressure drop testing device showing the sleeve in an expanded condition and the filter rod being ejected from the encapsulating sleeve.

Once the testing cycle has been completed, the controllable valves 25,26,30 are moved to the positions illustrated in FIG. 4. The first controllable valve 25 is once again connected between the rigid vessel 12 and the inlet port 22*a* of the first stage 22 of the vacuum pump 20. Accordingly, the encapsulating sleeve 13 is expanded so that the filter rod 40 will be released from the grip of the sleeve.

The second controllable valve 26 is also moved to connect the exhaust port 23*b* of the second stage 23 of the vacuum pump 20 with the second end 15 of the encapsulating sleeve. The flow of air to the second end 15 of the encapsulating sleeve 13 causes a positive pressure to build up behind the filter rod 40 allowing the filter rod to be ejected from the encapsulating sleeve 13.

In some instances, the volume of the rigid vessel 12 (which contains the air which is passed through the pump 20 to the second end 15 of the sleeve 13) may not be enough to cause the filter rod to be fully ejected. In such situations, the third controllable valve 30 is moved to the position illustrated in FIG. 4 so that atmospheric air can be drawn in through the vent cap 31 to the manifold 24. The additional air drawn in through the vent cap 31 ensures that a sufficient volume of air is exhausted through the second stage 23 of the vacuum pump to fully eject the tested filter rod 40. After the test has been completed, the controllable valves 25,26,30 may be moved to their initial positions illustrated in FIG. 1. Accordingly, a device is provided which may be fully self contained and portable and which does not require separate sources of vacuum and compressed air.

The invention has been described in considerable detail with reference to preferred embodiments. However, many changes, variations, and modifications can be made without departing from the spirit and scope of the invention as described in the foregoing specification and found in the appended claims.

That which is claimed is:

1. A device for testing a pressure drop across a filter rod comprising:

a sleeve for encapsulating a filter rod, said sleeve having a first end through which the filter rod is inserted into said sleeve;

a vacuum pump including at least one inlet port and at least one exhaust port, said vacuum pump having two stages arranged in series;

at least one controllable valve for selectively connecting a second end of said sleeve to said inlet port of said vacuum pump or to said exhaust port of said vacuum pump;

a pressure sensor connected between said inlet port and said second end of said sleeve; and a controller for causing said vacuum pump to test and then eject the filter rod, said controller connected to said at least one controllable valve for operating said valve to create a pressure drop across the filter rod when said inlet port is connected to said sleeve, and to eject the filter rod from said sleeve when said exhaust port is connected to said sleeve.

2. A pressure drop testing device as defined in claim 1 further comprising a rigid outer vessel connected to the outer surface of both ends of said sleeve, wherein said sleeve is expansible and wherein said at least one controllable valve further comprises:

a first controllable valve for selectively connecting said inlet port of said vacuum pump to said second end of said sleeve to create the pressure drop across the filter rod or to said rigid vessel to expand said sleeve; and a second controllable valve for connecting said exhaust port of said vacuum pump to said second end of said sleeve to eject the filter rod therefrom.

3. A pressure drop testing device as defined in claim 2 wherein said vacuum pump further comprises first and second stages, each of said stages including an inlet port and an exhaust port.

4. A pressure drop testing device as defined in claim 3 further comprising a manifold connecting said exhaust port of said first stage with said inlet port of said second stage.

5. A pressure drop testing device as defined in claim 4 further comprising a third controllable valve for directing atmospheric air to the rigid vessel when the sleeve is expanded to vent the vacuum therein and allow the sleeve to contract, or for directing atmospheric air to the manifold to increase the volumetric flow rate of air through the second stage of the vacuum pump to eject the filter rod from the sleeve.

6. A pressure drop testing device as defined in claim 5 wherein said controllable valves are electronically activated solenoid valves.

7. A device for testing a pressure drop across a filter rod comprising:

a rigid outer vessel;

an expansible sleeve extending through said rigid vessel for encapsulating a filter rod, said sleeve having a first end through which the filter rod is inserted into said sleeve when said sleeve is in an expanded condition;

a vacuum pump having first and second stages, each of said stages including an inlet port and an exhaust port;

a manifold connecting said exhaust port of said first stage with said inlet port of said second stage;

a first controllable valve for selectively connecting said inlet port of said first stage to said second end of said sleeve to create the pressure drop across the filter rod or to said rigid vessel to expand said sleeve;

a second controllable valve for connecting said exhaust port of said second stage to said second end of said sleeve to eject the filter rod from the first end of said sleeve; and a third controllable valve for connecting said manifold to the atmosphere to allow a predetermined volumetric flow rate of air through the second stage of the vacuum pump to eject the filter rod.

8. A pressure drop testing device as defined in claim 7 further comprising a flow limiter between said vacuum pump and said second end of said sleeve to provide a substantially constant volumetric flow rate through the filter rod.

9. A pressure drop testing device as defined in claim 8 wherein said flow limiter comprises a critical flow orifice.

10. A pressure drop testing device as defined in claim 7 further comprising a controller for operating said valves.

* * * * *